United States Patent [19]

Galiger

[11] 4,347,727

[45] Sep. 7, 1982

[54] PROGRAMMABLE UPWARD-STROKE INSERT MECHANISM FOR BENDING BRAKES AND METHOD OF USE

[76] Inventor: Barry J. Galiger, 10915 Westgate Dr., Overland Park, Kans. 66210

[21] Appl. No.: 172,698

[22] Filed: Jul. 28, 1980

[51] Int. Cl.[3] ..... B21D 7/06

[52] U.S. Cl. ..... 72/389; 72/452

[58] Field of Search ..... 72/389, 386, 446, 447, 72/448, 452

[56] References Cited

U.S. PATENT DOCUMENTS

| | | | |
|---|---|---|---|
| 2,199,864 | 5/1940 | Wehr | 72/448 |
| 2,456,856 | 12/1948 | Bath | 72/481 |
| 2,826,947 | 3/1958 | Creek | 72/448 |
| 3,007,508 | 11/1961 | Giordano | 72/386 |
| 3,844,156 | 10/1974 | Hanni | 72/389 |
| 3,914,975 | 10/1975 | Kawano | 72/389 |
| 3,965,721 | 6/1976 | Roch | 72/389 |
| 3,983,735 | 10/1976 | Berry | 72/319 |
| 4,106,323 | 8/1978 | Haenni | 72/389 |
| 4,137,748 | 2/1979 | Grombka | 72/448 |

FOREIGN PATENT DOCUMENTS

| | | | |
|---|---|---|---|
| 780165 | 7/1957 | United Kingdom | 72/452 |

*Primary Examiner*—Gene Crosby

*Attorney, Agent, or Firm*—Jerome A. Gross

[57] ABSTRACT

Retrofit apparatus for a press brake to make it capable of programmed operation, has an inclined support mounted on the lower bed of the press brake upon which is slided a plurality of wedges beneath a transversely-restrained, vertically-mobile die holder. The wedges are coupled at their aft sides to a horizontal beam driven transversely and reciprocatingly by a linear actuator at its center to provide vertical motion to the die holder; the deflection of the center-driven beam provides a crown to the die holder corresponding to the inherent upward bow of the upper ram.

The method of use comprises the steps of positioning the workpiece horizontally, and vertically lowering an upper ram from above the workpiece until a die mounted on its lower end contacts the upper side of the workpiece, clamping it in place. Then, a lower die holder cammed upwardly relative to the press bed, to make the desired bend in the workpiece.

12 Claims, 5 Drawing Figures

PROGRAMMABLE UPWARD-STROKE INSERT MECHANISM FOR BENDING BRAKES AND METHOD OF USE

BACKGROUND OF THE INVENTION

The present invention relates to press brakes, and specifically to those in which the upper ram is moved downward toward the press bed by actuators at its ends. By the present invention, the lower die is mounted not on the bed, but on an inserted upward-stroke mechanism. The ram is then used only for preliminary positioning and clamping the workpiece; the bending stroke is performed by the insert mechanism. Its stroke length is so precise that any desired degree of bend may be formed with repeatability; so that a series of different bend angles may be programmed.

In conventional press brakes, an upper ram carrying a male die is lowered toward a fixed lower beam or bed bearing a female die, either by pitman arms or by a pair of linear actuators mounted at the ends of the ram. The depth of penetration of the male die into the female die determines the angle of the bend. No provision is normally made to assure repeatability of depth of penetration.

When heavy metal workpieces are formed, the upper ram and lower bed tend to deflect apart, this deflection being greatest at their longitudinal center, and may become permanently deformed. As a result (either of elastic deflection or permanent deformation) the angle of the bend in a long sheet metal member will vary along its length, being less at the center.

To overcome the problem of deflection at the center and make it possible to program a series of bends in the same workpiece, at least one manufacturer of press brakes, Promecam, Saint Denis, France, utilizes a movable lower ram driven at its center by a vertically-acting hydraulic cylinder, whose movement can be precisely programmed to perform a series of bends to different angles. As described in its U.S. Pat. No. 3,007,508, the center drive causes the lower ram to deflect upward at its center or "crown", compensating for the upward deflection at the center of the upper beam. A lower ram type press brake, manufactured by Fabco, Inc., Lewisville, Tex., utilizes a hydraulic-actuated wedge arrangement, operating in the vertical plane of the ram, to drive the ram upward. Others have used wedge arrangements to provide "crown" or to compensate for other inaccuracies in the ram, such as shown in U.S. Pat. Nos. 2,199,864, 2,456,856 and 3,965,721, or to adjust the level of a tool, as in U.S. Pat. Nos. 3,844,156 and 4,137,748.

SUMMARY OF THE INVENTION

The principal purpose of the present invention is to provide a method and apparatus by which conventional press brakes may be retrofitted to provide for such precise repeatability of bends to chosen angles that they may be programmed in series, with compensation for the deflection of the upper ram from the bed. Other purposes include providing a press brake which preliminarily clamps the workpiece at a rapid speed, and then, performs the bending operation at a slower rate of stroke to avoid that type of deformation of the workpiece known as "whip-up".

Briefly summarized, the method of the present invention includes the steps of first horizontally positioning the workpiece and then lowering an upper ram by actuators at its ends until the lower edge of the male die contacts the upper side of the workpiece. The bending stroke, whose length is programmed to effect the desired bend, is then made by an inserted die holder mechanism bending the lower female die, elevated by novel linear actuator means which act at the center of the ram. One effect is to compensate for deflection of the press.

Another result is greatly increased speed of precise forming. The stroke of the upper ram, substantially longer than that of the lower ram, to permit easy insertion and removal of workpieces, is effected at a high velocity; while the inserted lower die holder or ram is driven slowly and precisely over a short stroke required for actual bending. The total operation is thereby performed with speed and accuracy.

The unique apparatus by which the method is carried out is utilized with advantage to retrofit conventional press brakes of the type having an elongated upper ram mechanism whose ends are driven by a pair of pitman arms or vertically-acting linear actuators, and having an elongated lower beam or bed in the same vertical plane as the ram. The new insert apparatus is supported on the upper edge of the bed, and extends aft and downward, so as to require little space above the bed. Its actuating mechanism acts transversely to the bed. A planar surface inclined transversely to the bed slidably supports a plurality of spaced-apart wedges having horizontal planar upper surfaces. These upper wedge surfaces support an elongated die holder; on transversely reciprocating movement of the wedge surfaces the die holder reciprocates vertically, being restrained and guided by vertically-extending guides between the wedges. Finally, the upper ram 11 is rapidly raised and the workpiece 100 removed.

Where parts are being formed repeatedly of the same thickness of sheet metal, it may not be necessary to vary the shut height position of the upper ram 11. However, where a bend of substantial angularities causes a portion of the workpiece to project upward behind the ram, it may be advantageous to raise the ram on its up stroke, to the maximum extent. This raising to permit removal of bent workpieces is accomplished automatically by programmed inputs from the control 80 and the upper ram switch 83, bringing the ram 11 to maximum top position after each forming stroke is completed.

The present inventive apparatus is advantageously used in retrofitting existing press brakes, as well as new ones. By mounting the mechanism 25 onto the upper edge of the press bed 20, the transverse component of force exerted by the actuator 70 is reacted at nearly the same elevation, along the bed 20, as that at which this force component is applied. Hence, no deflection is experienced out of the vertical plane of the bed 20.

The inclined lower ram mechanism 25 is of such short vertical dimension as to be easily accommodated within the vertical space between the bed 20 and upper ram mechanism 10, which is of limited height. Use of the 30° inclination is advantageous in several ways. First, a 2:1 mechanical advantage is gained, reducing the required capacity of the linear actuator 70, as well as the strength, and therefore size, of the beam 50. Next, the 2:1 linear travel ratio permits a two inch extension of the actuator rod 71 for each inch of vertical movement for the die holder 60, resulting in an increase in forming accuracy.

The present invention may be expressed as a method of press brake bending a workpiece of ductile material, which essentially begins with the step of positioning the workpiece substantially horizontally between an upper downward acting ram and a lower upward-acting ram mechanism supported by a bed. Next, the upper ram is lowered in a substantially vertical plane by driving means at its two ends for a stroke which continues until the upper die substantially contacts the upper side of the workpiece. Upward camming forces transverse to the bed are then applied between the bed and the lower die by wedges propelled by a beam driven by a linear actuator at the beam's longitudinal center. To compensate for deflection of the press brake ram, the beam stiffness is proportioned to permit a small amount of aft bowing deflection outward of center. The upward camming force elevates the lower die a precise stroke length, into complementary relationship with the upper die, to make a bend of the angle desired.

Modifications of the embodiment described above will be apparent to persons skilled in the art. For example, instead of the hydraulic circuit being encoded in the manner shown, travel of the linear actuator may be stopped at a controllable servo valve actuating position, which serves at a target position for gradually stopping the actuator precisely. Further, other means to drive wedge-like members transversely and reciprocatingly and thereby provide a vertical stroke to the die holder may be substituted, as well as other transversely operating camming means, other vertically extending guide means to restrain the die holder from transverse movement, and other means to mount the linear actuator from the wedges onto the bed of the press brake. From these examples, other modifications will suggest themselves. Each wedge is adjustably positioned relative to a horizontal beam which drives the wedges; the driving beam is parallel to and reciprocable transversely to the bed of the press. A linear actuator, coupled to the longitudinal center of the beam, provides driving force. The beam will deflect somewhat outward of its center; and this deflection is taken advantage of to compensate for the greater deflection of the press ram at center; accordingly the beam stiffness is chosen to permit approximately that compensating amount of deflection, giving an action similar in result to that of the centrally upward-driven ram of the Promecam device. Adjustment of the spacings between the beam and wedges "fine-tunes" the mechanism.

A controller, such as a microprocessor, may be programmed to achieve a series of different bend angles, performed in the same workpiece, each angle being achieved by a precisely repeatable stroke. In each stroke the upper ram is first lowered as rapidly as desired until the upper die contacts the workpiece, without bending it out; then the controller operates the transverse actuator to elevate the female die at a lesser velocity and for a short stroke. This, together with the deflection-compensating feature above mentioned, achieves great accuracy of bend and hence programmable repeatability. The same controller may be utilized to program the operation of a backgage, so as to reposition the workpiece progressively as a series of bends are performed on it. Such programmable controllers which actuate the forming strokes are conventional "off-the-shelf" items.

DESCRIPTION OF THE PREFERRED EMBODIMENT

Figure 3:
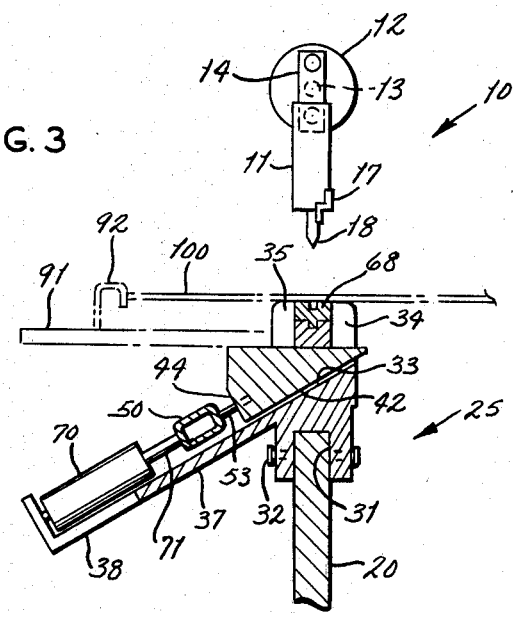
FIG. 3 is a side section, such as taken along line A—A of FIG. 1, showing the lower ram mechanism of FIG. 1 retrofitting a conventional press brake, shown fragmentarily. The lower ram is shown in its lowered position, the upper ram is in its raised position, and a sheet metal workpiece is supported on the lower ram mechanism.
Figure 4:
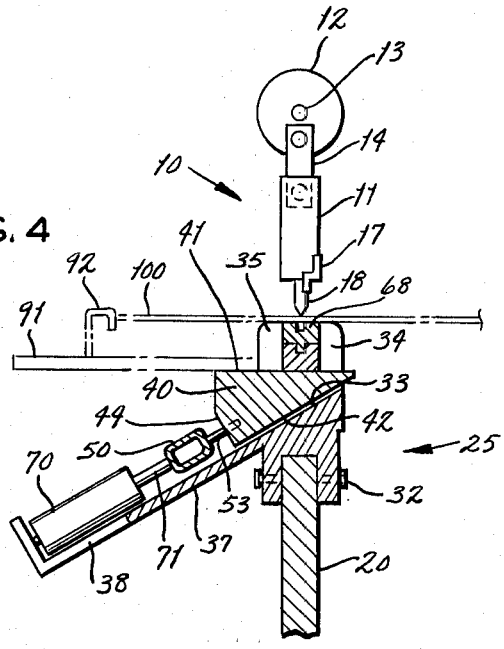
FIG. 4 is a section, similar to FIG. 3, showing the upper ram lowered to clamp the workpiece.
Figure 5:
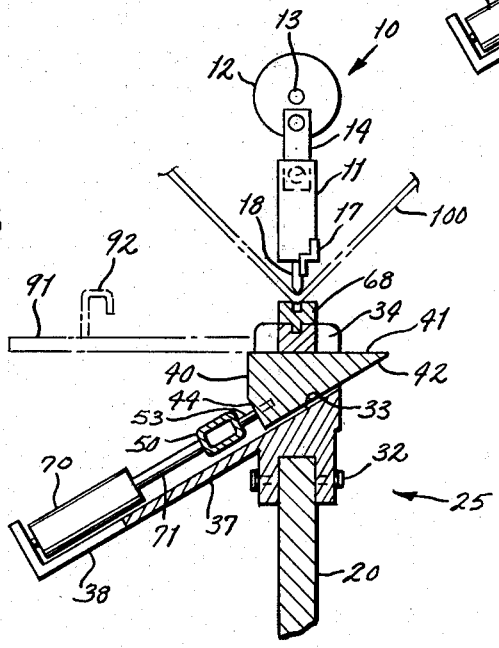
FIG. 5 is a section similar to FIG. 3, showing the lower inserted die holder raised to form the desired bend in the workpiece.

A conventional press brake illustrated only fragmentarily in the drawings, has an elongated upper ram mechanism, generally designated 10, driven by a pitman arm mechanism and shown substantially in FIGS. 3, 4 and 5. A thick vertical plate forms its ram 11, which is guided by vertical supports, not shown. An eccentric arm 12 is mounted over the ram 11 on a motor-driven shaft 13. A connecting rod or pitman arm 14 links the crank arm 12 to the ram 11. In order to set the vertical level to which the ram descends on forming a workpiece, apparatus, not shown, is provided to elevate and lower the upper ram mechanism 10. Clamping means 17 at the lower end of the ram 11 fastens the elongated upper male die 18 in place.

Conventional press brakes also have a fixed lower frame part or bed 20, usually in the form of a thick vertical plate or a deep beam directly beneath the upper ram, as fragmentarily shown in FIG. 35. The bed 20 conventionally supports a bolster block, which mounts the lower female die. In the present invention, the bolster block is removed and replaced by the wedge-actuated lower ram mechanism, generally designated 25, shown in FIG. 1 before mounting to the bed 20 of the press brake beneath the upper ram mechanism 10. After retrofit with the insert mechanism 25, the press brake has in effect both upper and lower ram mechanisms, both used in forming as hereafter described.

The lower insert mechanism 25, which may be referred to as a lower ram, includes an elongated frame or mechanism support 30 whose lower portion is an inverted channel portion 31, which accepts matably the upper edge of the press brake bed 20. Bolts 32 are threaded horizontally through the walls of the channel portion 31 to secure the frame 30 to the bed 20. The upper side of the frame 30 has a transversely inclined planar upper surface 33, which slopes downward fore-to-aft at 30° relative to horizontal, in the embodiment shown.

A plurality of spaced-apart guides extend vertically upward from the inclined upper surface 33, including forward guides 34 at the forward side of the frame 30 and opposed aft guides 35 at the aft side of the frame 30. The planar inner faces of the forward guides 34 lie in a common vertical plane, and the planar inner faces of the aft guides 35 similarly lie in another parallel vertical plane; the slot-like space between the forward and aft guides 34, 35 accepts an elongated die holder 60, described below. The transversely-extending faces of the guides 34, 35 likewise extend in parallel vertical planes, and the transversely-extending faces of opposed forward and aft guides lie in common planes, so that transversely-extending wedges 40, described below, may be slided between the guides 34, 35 on the inclined upper surface 33 of the frame 30 to cam the die holder 60 upward.

The frame 30 further includes an inclined hydraulics support member or yoke 37 extending aft of and substantially coplanar with the planar upper surface 33. In the preferred embodiment, the yoke 37 ends aftwardly in a generally rectangular portion 38 at the longitudinal center of the press brake.

The insert mechanism 25 is provided with a plurality of substantially identical wedges 40, each having a planar horizontal upper surface 41 and a planar transversely-inclined lower surface 42, which slopes downward fore-to-aft at 30° relative to horizontal. The transversely-extending sides 43 of each wedge 40 are vertical and parallel, the widths of the wedges 40 being such as to be accepted slidably in the transversely extending slots formed by the guides 34, 35 of the lower ram frame 30. The aft side of each wedge 40 has a coupling portion 44 substantially perpendicular to the wedge lower surface 42, to which the force for sliding movement of the wedge 40 is applied.

An elongated rectangular tubular steel beam 50 extends along the coupling portions 44 of the wedges 40, generally parallel to the bed 20 and frame 30. The stiffness of the beam 50 is sized empirically to compensate for the deflection characteristics of the press upper ram 11 and bed 20, as well as any permanent deformation, to which they may have been subjected. A central point on the coupling portion 44 of each wedge 40 is coupled to the beam 50 by a short hexagonal spacing rod 53 having oppositely threaded ends 54 which are accepted by oppositely threaded bores in the wedge coupling portions 44 and in the beam 50. Jam nuts 55 on the threaded ends 54 secure the hexagonal rods 53. The spacing between the beam 50 and each individual wedge 40 may thus be adjusted.

An elongated die holder 60 is supported on the plurality of wedges 40 lengthwise between the forward-and-aft guides 34, 35 and has a forward vertical edge 61 and an aft vertical edge 62. Its width between these vertical edges 61, 62 is such as will permit upward sliding of the die holder 60 between the guides 34, 35 without any substantial transverse movement. The upper side of the die holder 60 has an elongated horizontal slot 63 which will accept a lower die 68, as shown in FIGS. 3–5. Along its lower side, the die holder 60 has a plurality of transversely horizontal portions 65, such as shown by FIG. 35, separated by deepened portions 66, such as seen at the end of the lower ram mechanism shown in FIG. 1. The horizontal portions 65 rest upon the upper surfaces 44 of the wedges, while the deepened portions 66 extend downward between the wedges, slidably mated between the opposed forward-and-aft guides 34, 35. A purpose of the deepened portions 66 is to reduce any tendency for the die holder 60 to tip or otherwise rotate.

As shown in FIGS. 3–5, the height of the die holder 60, with its die 68, relative to the vertical guides 34, 35 of the frame 30, permits the die 68, when the die holder 60 is slided upward, to extend above the guides 34, 35 for forming of a workpiece 100. As shown in FIG. 3, the upper end of the lower die 68 is at or above the level of the upper side of the guides 34, 35 before the die 68 is elevated. Thus, the length of travel of the lower ram mechanism to do the forming will be minimized, while the downward stroke of the upper ram 11 may be much greater, to permit adequate clearance for inserting and removing the workpiece.

The upper surface 33 of the frame 30 and upper and lower surfaces 41, 42 of the wedges 40 preferably provide minimal friction. These surfaces, as well as other surfaces in sliding contact, may be bronze or a nonmetallic low-friction material. A hydraulic linear actuator 70 of the single-acting type is mounted on the upper side of the aft-most rectangular portion 38 of the hydraulics support yoke 37, extending angularly forward and upward in substantial alignment with the yoke 37. The extensible rod 71 of the linear actuator 70 is coupled to the longitudinal midpoint of the driving beam 50. On extension of the actuator rod 71, the beam 50 is pressed forward, driving the wedges 40 forward beneath the die holder 60 on the camming upper surface 33 of the frame 30, and thereby elevating the die holder 60. While the weight of the movable elements, including the die 68, die holder 60, wedges 40, and beam 50 may be sufficient to return the single-acting linear actuator 70 to retracted position when the hydraulic pressure is released, for faster, more positive action, a return spring (not shown) may be added or a conventional double-acting linear actuator utilized.

Figure 2:
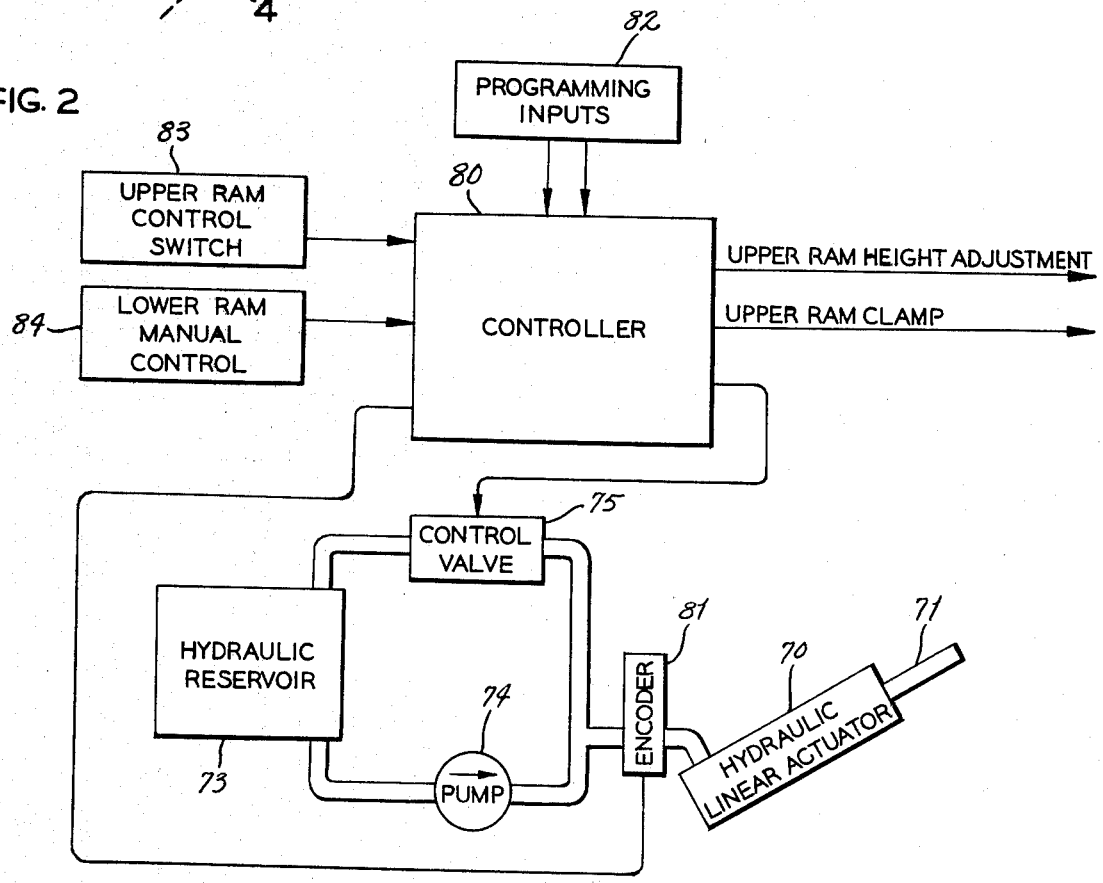
FIG. 2 is a block-diagram schematic of a control system for use with the mechanism shown in FIG. 1.

FIG. 2 shows in simple schematic form a control system for accomplishing the operation of the mechanical apparatus. A hydraulic system includes a fluid reservoir 73 in circuit with a hydraulic pump 74 and a normally open steplessly variable control valve 75 on the outlet side of the pump 74, which returns the fluid to the reservoir 73. The hydraulic linear actuator 70 is supplied by a hydraulic line coupled from the outlet of the pump 74. By selectively closing down the control valve 75, fluid flow is in part diverted to actuate the linear actuator 70, at a rate of travel variable by the control valve 75.

The control system also includes an electronic controller 80 which serves to first cause the upper ram 11 to be lowered by actuating its crank and pitman driving means, until the upper die 18 makes contact with a sheet metal workpiece 100 resting on the lower die. This may effectively clamp the workpiece 100 in place. Thereafter, the controller causes the linear actuator 70 of the lower ram mechanism 25 to extend a precise length for forming the desired bend. Electronic controllers of this type with programmable inputs as hereafter described are well known in the art and are commercially available throughout the United States and in foreign countries.

An encoder 81, which may include a gear motor through which hydraulic fluid flows to and from the actuator 70, supplies an electrical input to the controller 80 constantly indicating the precise extension of the actuator 70 and hence the elevation of the lower ram mechanism 25. Programming inputs 82 are utilized to set the end of the driving stroke of the lower ram mechanism 25 to achieve the angle of bend desired. Where workpieces of different thickness are to be operated in a series, similar programming inputs may, if desired, also be employed to adjust the shut-height of the upper ram according to the thickness of the workpiece 100.

In a simple manner of operation, an upper ram control switch 83 is utilized to initiate descent of the upper ram 11 to clamp.

Outputs from the controller 80 to set the shut-height of the upper ram 11 through a motor and conventional eccentric mechanism, not shown. Conventional elements of the hydraulic system and control circuitry may be protected by conveniently mounting them on the underside of the frame yoke 37.

A lower ram manual control 84 controls the flow of hydraulic fluid to the linear actuator 70 via the steplessly variable control valve 75.

As illustrated in FIGS. 3–5, an otherwise conventional backgage mechanism may be secured to the aft side of the lower ram mechanism 25. A horizontal backgage support arm 91 is shown in phantom lines, mounted to the aft side 62 of the die holder 60, extending between two of the aft vertically-extending guides 35 of the frame 30. The support arm 91 supports a variable backgage stop 92, not the subject of the present invention, which may if desired be operated by the controller 80 where a series of bends on the same workpiece is programmed. This mounting is advantageous in that the backgage is elevated along with the lower die, as illustrated in the transition from FIG. 4 to FIG. 5.

Figure 1:
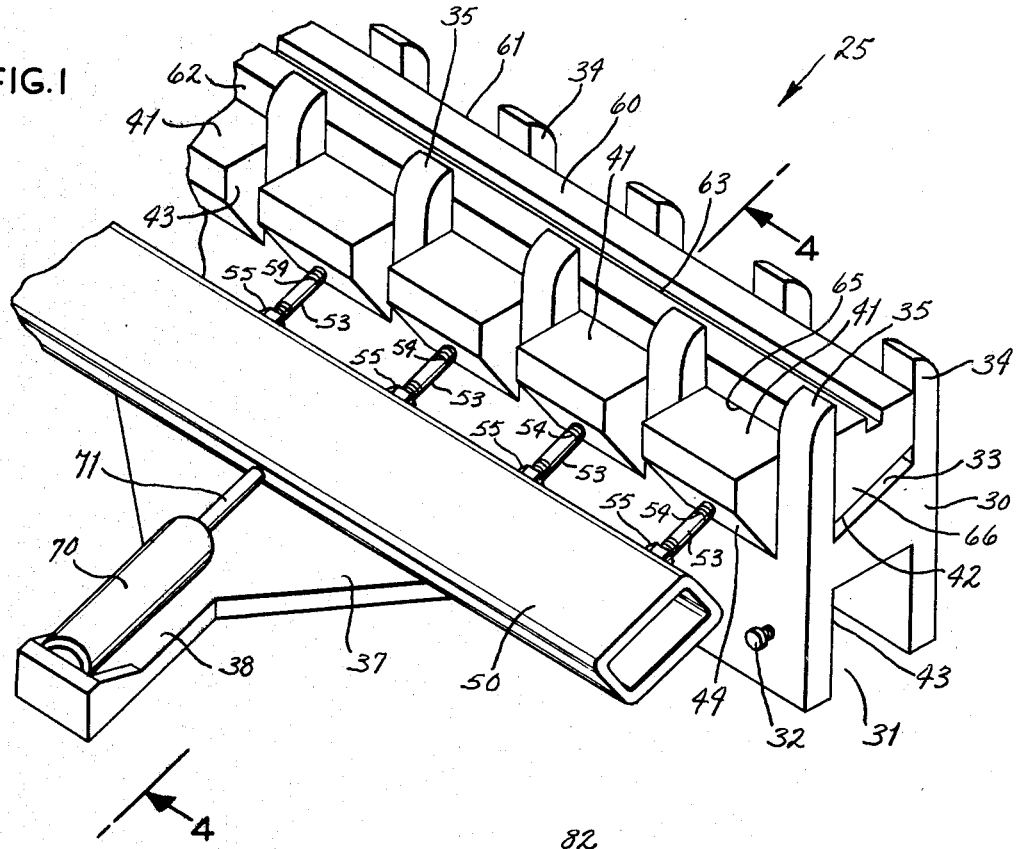
FIG. 1 is an oblique projection of a wedge-actuated lower ram mechanism, embodying the present invention, which may be utilized to retrofit an existing press brake for precise forming.

In operation of a press brake retrofitted with the lower ram mechanism 25 of FIG. 1, a ductile sheet metal workpiece 100 is positioned substantially horizontally between the upper ram mechanism 10 and lower ram mechanism 25, each of which have been fitted with the proper male and female dies 18, 68 for the bending operation desired. The workpiece 100 rests on the lower die 68. The shut-height of the upper ram mechanism 10, which is the opening between the dies 18, 68 when the upper ram 11 is elevated, is adjusted so that when the upper ram 11 is lowered, the upper die 18 contacts and preferably substantially clamps the workpiece 100. This contacting position is preferably chosen to be when the crank arms 12 and pitman arms 13 are vertical, to provide maximum resistance to the pressure of the lower ram mechanism 25. The upper ram 11 may then be lowered at a rapid rate, the operator using a two-hand control switch with conventional safety features. After the material is contacted by the upper ram 11 the operator may visually check the positions of the workpiece, before the upward forming stroke hereafter described.

After the workpiece is so contacted by the upper ram mechanism 10, the lower ram control 84 is actuated, closing the hydraulic control valve 75 to divert fluid to the linear actuator 70, extending its rod 71, driving the beam 50 forward and upward along with the wedges 40, to apply an upward camming force between the planar upper surface 33 of the frame 30, supporting by the bed 20, and the die holder 60. The die 68 mounted in the die holder 60 is thereby elevated into the upper die 18, bending the workpiece. The controller 80 monitors the extension of the linear actuator 70 by the encoder 81 and when the linear actuator extension reaches the length programmed into the controller 80, the lower ram control 84 is overridden and the control valve 75 is opened, dumping the fluid from the linear actuator 70 and allowing it to retract. The rate of upward travel of the lower ram in the forming stroke may be much slower than the rapid clamping stroke of the upper ram 11. On completion of the bending stroke, the actuator 70 is retracted, by weight of the mechanical elements augmented if desired by a return spring, or by using a double-acting actuator programmed to provide a controlled retraction of the actuator and hence opening speed. This will assist the operator in handling heavy projecting workpieces as they are released from the press brake.

I claim:

1. A method of press brake bending a workpiece of ductile material, comprising the steps of positioning the workpiece substantially horizontally between the upper downward-acting ram of a press brake having an elongated upper die and a lower upward-acting die holder inserted above and supported by the press bed, lowering the upper ram and continuing until the upper die substantially contacts the workpiece, and applying an upward camming force between the bed and the lower die-holder and transversely thereto and by such camming force driving the die-holder upward, whereby a die in such die-holder mating with such upper die will bend the sheet in an upward forming stroke.

2. The method defined in claim 1, wherein the step of applying an upward camming force includes applying such camming force with a stroke which lessens outward from the midpoint of the lower die-holder by an amount which substantially accommodates the greater central deflection of the brake between its ram and its bed.

3. A method of press brake bending a sheet of ductile material, comprising the steps of positioning a workpiece substantially horizontally, lowering, from above the workpiece and in a substantially vertical plane, an elongated upper ram by driving means at its two ends, until a first die part on its lower side substantially contacts the upper side of the workpiece, and elevating, beneath the workpiece and in the same substantially vertical plane, an elongated lower die-holder by a controlled stroke of linear actuator means acting out of said plane at the longitudinal center of the ram, the lower die-holder having on its upper side a complementary die part, whereby the controlled stroke of such linear actuator means forms a desired angle of bend in the workpiece.

4. The method defined in claim 3, wherein the step of elevating the elongated lower die-holder includes applying a camming force between it and the press bed therebeneath, together with the further step of retracting the stroke of the linear actuator at a controlled rate, whereby to assist the operator in handling a workpiece when released from the press brake.

5. For use with a press brake of the type having an elongated stationary lower bed and, in substantially the same vertical plane, an elongated upper ram mounting an upper die and having a pair of driving means, one at each end of the upper ram, for raising and lowering it in said vertical plane, insert mechanism comprising mechanism support means mounted to the upper side of the bed and having a planar upper surface portion inclined transversely to the bed, wedge means transversely slidable on said upper surface portion, the wedge means having a substantially horizontal upper side, an elongated die holder supported slidably on the horizontal planar upper side of said wedge means, and including means to accept and support thereon a lower die, vertically extending guide means to restrain the die holder from transverse movement relative to the support means, and means to drive the wedge means transversely and reciprocatingly and thereby provide an upward vertical stroke to the die holder, whereby, on first lowering the upper ram to come substantially into contact with the upper surface of a workpiece resting on said die in said die-holder, the upward vertical stroke so provided will bend the workpiece.

6. The apparatus as defined in claim 5, further comprising controller means to program said means to drive the wedge means so as to provide a series of vertical strokes of different lengths whereby a series of different angular bends may be formed on the same workpiece.

7. The apparatus as defined in claim 5, further comprising means to mount the said mechanism on the elongated lower bed of such press brake whereby the transverse thrust of said means to drive the wedge means is reacted at the level of mounting on the lower bed, thereby avoiding substantial transverse deflection of said bed.

8. The apparatus as defined in claim 5, wherein the wedge means includes a plurality of spaced-apart wedges, and wherein the said means to drive the wedge means includes driving beam means extending parallel to the bed and mounted to the plurality of wedges, and a linear actuator coupled to the center of the driving beam means.

9. The apparatus as defined in claim 8, further comprising spacing means to adjust the positions of the wedges relative to the driving beam means, whereby to compensate for deflections.

10. An improved press brake, comprising

A. an upper ram mechanism including (1) an elongated upper ram having means along its lower edge to mount an upper die, and (2) a pair of vertically-acting driving means, one at each end of the upper ram, B. a lower mechanism beneath the upper ram mechanism including (1) elongated mechanism support means including a transversely-inclined planar upper surface portion, (2) a plurality of spaced-apart wedges, each having a transversely-inclined planar lower surface slidably supported on the upper inclined surface portion of the support means, and each having a horizontal planar upper surface, (3) an elongated die holder supported slidably on the horizontal planar surfaces of the wedges and including means to accept and support thereon a lower die, (4) vertically-extending guide means to restrain the die holder from transverse movement relative to the support means, (5) a driving beam means extending parallel to the elongated support means and mounted to the plurality of wedges, and (6) a linear actuator coupled to the longitudinal center of the beam means, whereby to drive the plurality of wedges transversely and thereby provide a vertical stroke to the die holder.

11. The press brake defined in claim 10 wherein in the upper drawing means lowers (1) the upper ram until a die mounted thereon will make contact with a sheet of material thereunder without substantially bending same, further comprising controller means to actuate the lower linear actuator to provide a controlled vertical stroke to the lower die holder, whereby a lower die mounted on the die holder will form the desired bend.

12. The press brake defined in claim 10, and further comprising spacing means to adjust the positions of the wedges relative to the driving beam means, whereby to provide compensation for deflections attending such vertical stroke.

* * * * *

UNITED STATES PATENT AND TRADEMARK OFFICE

CERTIFICATE OF CORRECTION

PATENT NO. : 4,347,727

DATED : September 7, 1982

INVENTOR(S) : PROGRAMMABLE UPWARD-STROKE INSERT MECHANISM FOR BENDING BRAKES AND METHOD OF USE

It is certified that error appears in the above—identified patent and that said Letters Patent is hereby corrected as shown below:

In column 7, line 47, delete "supporting" and insert ---supported---.

In column 10, line 28, delete "in" after "wherein".

In column 10, line 29, delete "drawing" and insert ---driving---.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*